US007639189B2

(12) United States Patent
Kim et al.

(10) Patent No.: US 7,639,189 B2
(45) Date of Patent: Dec. 29, 2009

(54) ANTENNA DEVICE OF A MOBILE TERMINAL

(75) Inventors: Yong Hyun Kim, Gumi-si (KR); Dong Woo Kim, Daegu Metropolitan (KR); Hong Chul Park, Gumi-si (KR); Kyung Mok Yoo, Gumi-si (KR); Sung Kee Kim, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 143 days.

(21) Appl. No.: 11/780,795

(22) Filed: Jul. 20, 2007

(65) Prior Publication Data

US 2008/0079651 A1 Apr. 3, 2008

(30) Foreign Application Priority Data

Oct. 2, 2006 (KR) ..... 10-2006-0097046

(51) Int. Cl.
*H01Q 1/24* (2006.01)

(52) U.S. Cl. ..... 343/702

(58) Field of Classification Search ..... 343/702, 343/895, 700 MS

See application file for complete search history.

(56) References Cited

U.S. PATENT DOCUMENTS

| | | | | |
|---|---|---|---|---|
| 6,856,819 | B2 * | 2/2005 | Itoh | 455/575.7 |
| 7,023,385 | B2 * | 4/2006 | Harihara | 343/700 MS |
| 7,068,230 | B2 * | 6/2006 | Qi et al. | 343/702 |
| 7,298,337 | B2 * | 11/2007 | Seol et al. | 343/702 |
| 2002/0000940 | A1 * | 1/2002 | Moren et al. | 343/702 |

FOREIGN PATENT DOCUMENTS

| | | |
|---|---|---|
| JP | 2003101335 | 4/2003 |
| JP | 2004235949 | 8/2004 |
| KR | 1020060068927 | 6/2006 |
| KR | 1020060112525 | 11/2006 |

* cited by examiner

*Primary Examiner*—Hoang V Nguyen
(74) *Attorney, Agent, or Firm*—H.C. Park & Associates, PLC

(57) ABSTRACT

An antenna device for a mobile terminal. The antenna device includes a first antenna pattern provided within a case of the mobile terminal, and a second antenna pattern provided within the case and electrically connected to the first antenna pattern through contact with the first antenna pattern. Therefore, by forming an antenna device with an antenna pattern for use in a low frequency band, the antenna device may be conveniently used and decrease the size of the mobile terminal.

9 Claims, 4 Drawing Sheets

ANTENNA DEVICE OF A MOBILE TERMINAL

CROSS REFERENCE TO RELATED APPLICATIONS

This application claims priority from and the benefit of Korean Patent Application No. 10-2006-0097046, filed on Oct. 2, 2006, which is hereby incorporated by reference for all purposes as if fully set forth herein.

BACKGROUND OF THE INVENTION

1. Field of the Invention

The present invention relates to an antenna device of a mobile terminal having a case, and more particularly, to an antenna device of a mobile terminal providing an antenna pattern in a case.

2. Discussion of the Background

Generally, a mobile terminal is an electronic device enabling a user to perform a function, such as wireless communication, network connection, and digital broadcasting reception without limitation to time. The mobile terminal includes an antenna device required for communication. The antenna device may be a conductive wire protruding out of the mobile terminal to emit an electric wave in space or to induce an electromotive force by an electric wave for wireless communication.

Hereinafter, a conventional antenna device of a mobile terminal for viewing terrestrial digital broadcasting is described with reference to the accompanying drawings.

FIG. 1 is a perspective view illustrating a mobile terminal having a conventional antenna device for terrestrial digital broadcasting. FIG. 2 is a perspective view illustrating a conventional external antenna device for digital broadcasting of a mobile terminal.

Terrestrial digital broadcasting uses a signal whose central frequency is 200 MHz in a frequency band of 184 MHz to 216 MHz. Accordingly, a wavelength, $\lambda$, is 1.5 m, and a proper antenna length is $\lambda/4$, i.e., 37 cm. An antenna whose antenna length is $\lambda/4$, i.e., 18 cm, may also be used.

Terrestrial digital broadcasting antenna 110 has a long length. In use, terrestrial digital broadcasting antenna 110 protrudes outside of mobile terminal 100, as shown in FIG. 1.

Accordingly, mobile terminal 100 may include a space to hold terrestrial digital broadcasting antenna 110 therein. Because it may be difficult to decrease a size of mobile terminal 100 and because terrestrial broadcasting antenna 110 protrudes outside of mobile terminal 100, antenna 110 may break when moving mobile terminal 100 while employing digital broadcasting; thus, it may be inconvenient to use mobile terminal 100.

In order to solve the aforementioned problem and to improve the appearance of mobile terminal 100, an antenna which does not protrude outside of mobile terminal 100, but may be provided inside mobile terminal 100, may be used. However, because an antenna, such as a terrestrial digital broadcasting antenna 110, operating in a low frequency band has a long length, it may be very difficult to enclose terrestrial digital broadcasting antenna 110 inside mobile terminal 100.

In order to solve the aforementioned problem, as shown in FIG. 2, external antenna device 210 for digital broadcasting coupled to mobile terminal 100 may be used. External digital broadcasting antenna device 210 may be coupled to mobile terminal 100 using coupling projection 211, which may be inconvenient for the user.

SUMMARY OF THE INVENTION

The present invention provides an antenna device for terrestrial digital broadcasting housed within the case of the mobile terminal without requiring a separate external antenna device or an antenna protruding outside of the mobile terminal.

Additional features of the invention will be set forth in the description which follows, and in part will be apparent from the description, or may be learned by practice of the invention.

The present invention discloses an antenna device of a mobile terminal having a case including a first antenna pattern provided within the case; and a second antenna pattern provided within the case, wherein the second antenna pattern contacts the first antenna pattern.

It is to be understood that both the foregoing general description and the following detailed description are exemplary and explanatory and are intended to provide further explanation of the invention as claimed.

BRIEF DESCRIPTION OF ILLUSTRATED DRAWINGS

The accompanying drawings, which are included to provide a further understanding of the invention are incorporated in and constitute a part of this specification, illustrate embodiments of the invention, and together with the description serve to explain the principles of the invention.

DETAILED DESCRIPTION OF EXEMPLARY EMBODIMENTS

Figure 1:
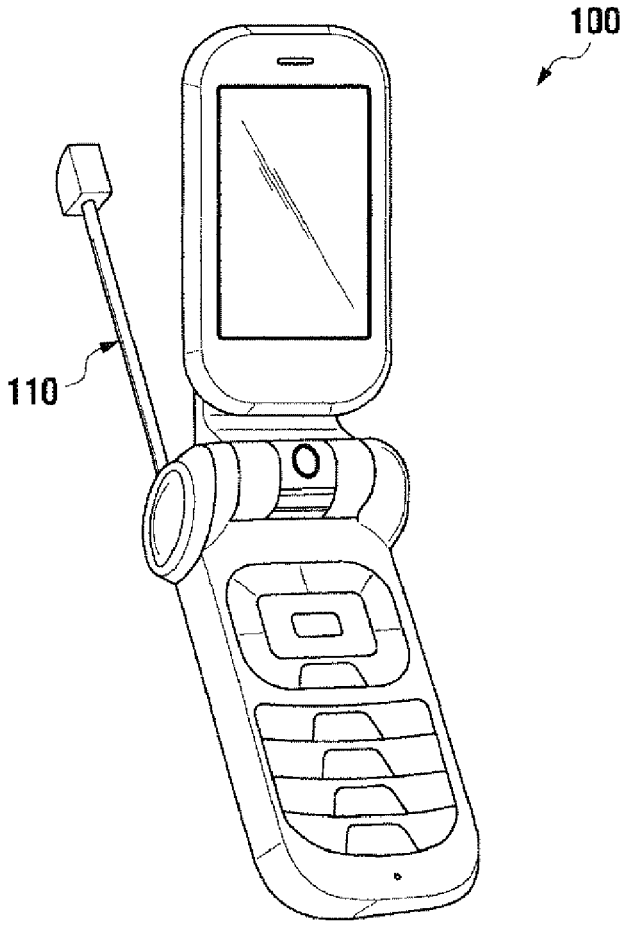
FIG. 1 ( PRIOR ART )
FIG. 1 is a perspective view illustrating a mobile terminal having a conventional antenna device for terrestrial digital broadcasting.

The invention is described more fully hereinafter with reference to the accompanying drawings, in which embodiments of the present invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative size of layers and regions may be exaggerated for clarity. Like reference numerals in the drawings denote like elements.

It will be understood that when an element such as a layer, film, region or substrate is referred to as being "on", "connected to", or "coupled to" another element or layer, it can be directly on, directly connected to, or directly coupled to the other element or layer, or intervening elements or layers may also be present. In contrast, when an element is referred to as being "directly on", "directly connected to", or "directly coupled to" another element or layer, there are no intervening elements or layers present.

A mobile terminal according to an exemplary embodiment of the present invention includes a case, a carrier, a feeding point, and a substrate. The case may include an upper case and a lower case. The upper case and the lower case are coupled to each other to form an external shape of the mobile terminal. The carrier may be provided within the case when the upper case and the lower case are coupled to each other. The feeding point may be positioned within the case of the mobile terminal to transfer a communication signal to the substrate through an antenna pattern.

Figure 3:
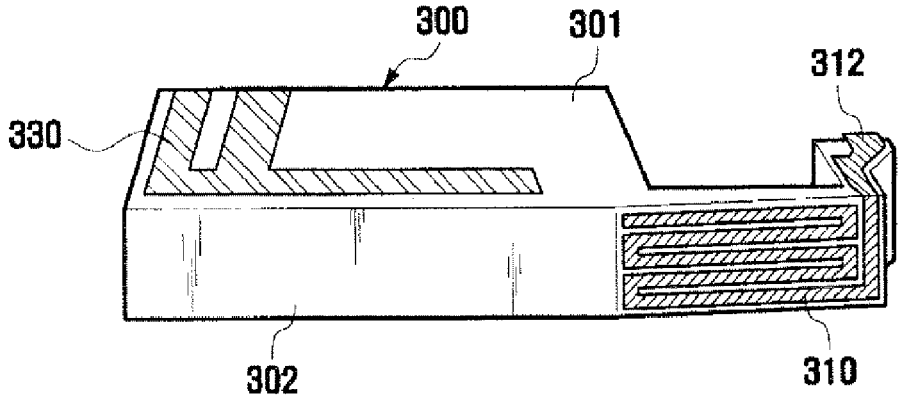
FIG. 3 is a perspective view illustrating a first antenna pattern formed in a carrier according to an exemplary embodiment of the present invention.

FIG. 3 is a perspective view illustrating a first antenna pattern formed in a carrier according to an exemplary embodiment of the present invention.

As shown in FIG. 3, first antenna pattern 310 may be formed in carrier 300. First antenna pattern 310 has first contact point 312 at one end thereof. Carrier 300 may be used to contain first antenna pattern 310 within the mobile terminal. First antenna patterns 310 may be formed by metal such as copper.

Carrier 300 includes upper surface 301, a lower surface (not shown), and side surface 302 for connecting upper surface 301 and the lower surface. First antenna pattern 310 may be formed in the side surface 302 of carrier 300. First contact point 312 may be formed in upper surface 301 of carrier 300. First antenna pattern 310 and first contact point 312 may be integrally formed.

First antenna pattern 310 and another antenna pattern for operating in a different frequency band may be formed in carrier 300. First antenna pattern 310 may be an antenna pattern for terrestrial digital broadcasting, and communication antenna pattern 330 may be included for communicating with the mobile terminal, when communication may be performed by a user of the mobile terminal. Communication antenna pattern 330 may be formed in upper surface 301 of carrier 300.

Figure 4:
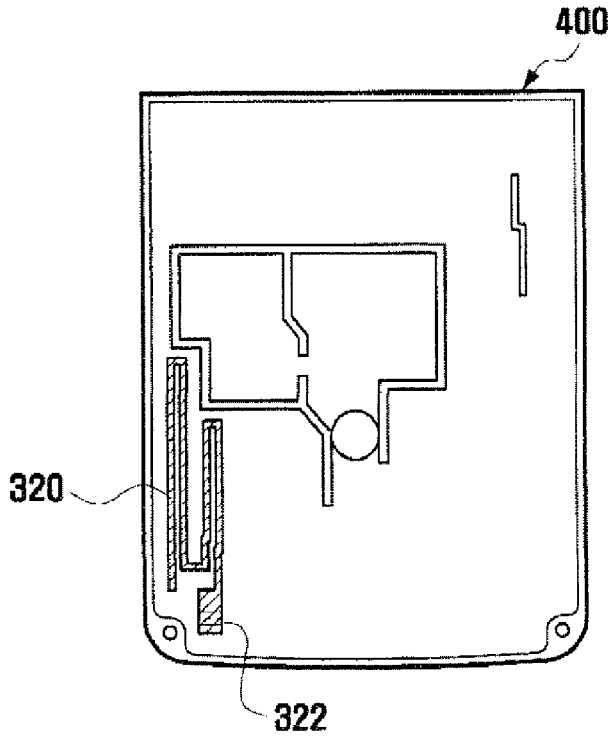
FIG. 4 is a plan view illustrating a second antenna pattern provided in a lower case of a mobile terminal according to an exemplary embodiment of the present invention.

FIG. 4 is a plan view illustrating a second antenna pattern provided in a lower case of a mobile terminal according to an exemplary embodiment of the present invention.

Second antenna pattern 320 may be formed on an inner surface of lower case 400 of the mobile terminal. An empty space may be inside the case of the mobile terminal. Second antenna pattern 320 may be provided and connected to first antenna pattern 310 in the space. Accordingly, although second antenna pattern 320 may be provided, a size of the case of the mobile terminal does not increase. The size of the space and the radiation performance of the antenna are considered in determining a shape of second antenna pattern 320. Second antenna patterns 320 may be formed by metal such as copper.

Second antenna pattern 320 has second contact point 322 at one end thereof. Second antenna pattern 320 and second contact point 322 may be integrally formed.

Figure 5:
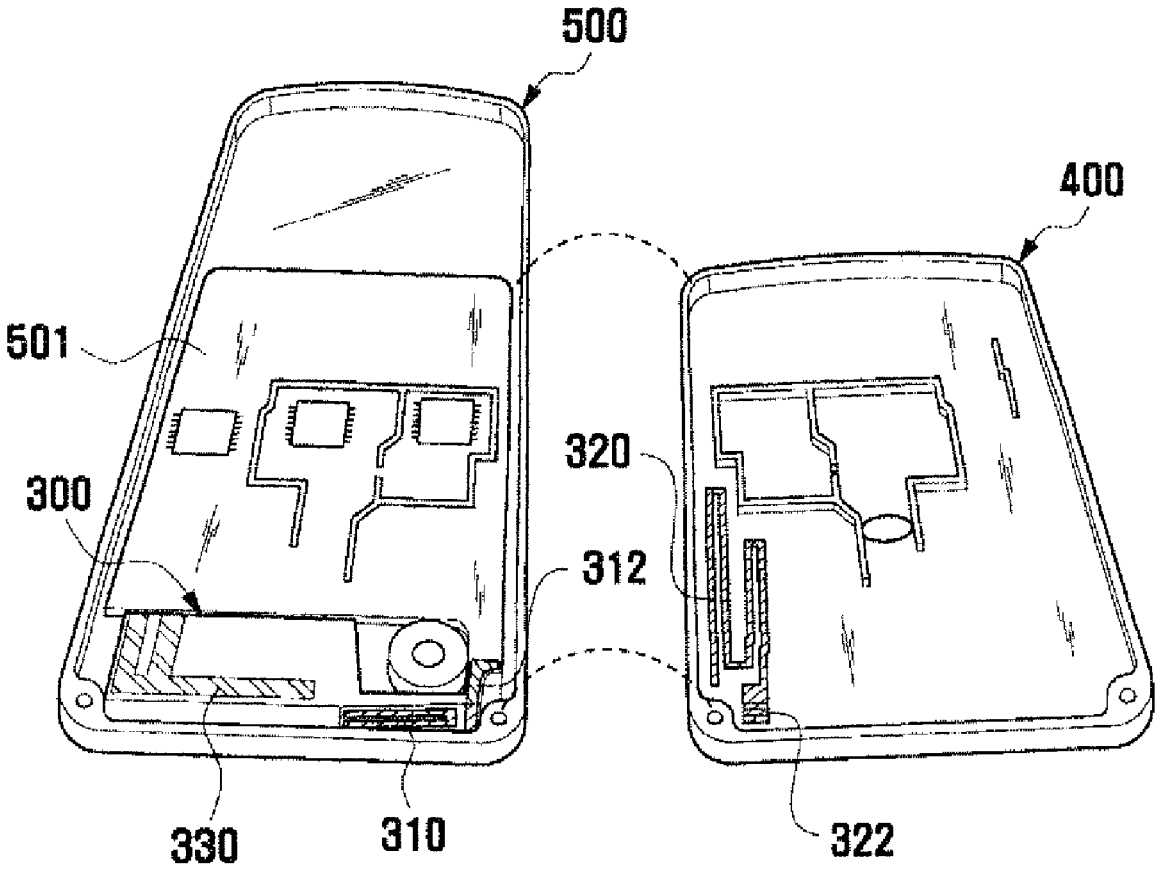
FIG. 5 is an exploded perspective view illustrating cases in which a carrier and second antenna pattern are provided according to an exemplary embodiment of the present invention.

FIG. 5 is an exploded perspective view illustrating cases in which a carrier and second antenna pattern are provided according to an exemplary embodiment of the present invention.

Carrier 300 may be provided on an inside surface of upper case 500 at one end thereof and may be provided in upper case 500 so that upper surface 301 having first contact point 312 faces outward from upper case 500.

Substrate 501 may be provided in upper case 500. A feeding point (not shown) may be formed at a point of contact between substrate 501 and first contact point 312.

Second antenna pattern 320 may be provided on an opposite surface of lower case 400 so that second contact point 322 faces upward from lower case 400.

In the present exemplary embodiment, carrier 300 may be provided within upper case 500, and second antenna pattern 320 may be provided within lower case 400. However, in another exemplary embodiment, carrier 300 may be provided within lower case 400, and second antenna pattern 320 may be provided within upper case 500.

When upper case 500 and lower case 400 are coupled to each other, first contact point 312 of first antenna pattern 310 and second contact point 322 of second antenna pattern 320 contact each other to be electrically connected.

Figure 6:
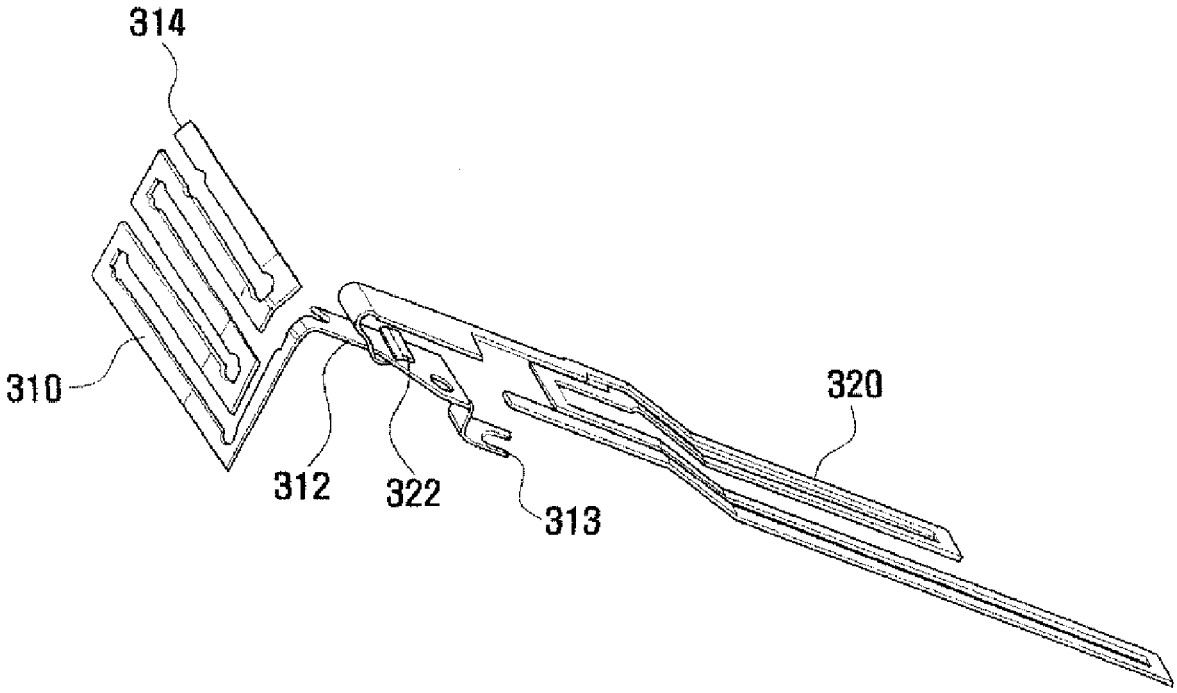
FIG. 6 is a view illustrating a first antenna pattern and second antenna pattern electrically connected to each other according to an exemplary embodiment of the present invention.

FIG. 6 is a view illustrating a first antenna pattern and second antenna pattern electrically connected to each other according to an exemplary embodiment of the present invention.

When the upper case and the lower case of the mobile terminal shown in FIG. 5 are coupled to each other, as shown in FIG. 6, first antenna pattern 310 and second antenna pattern 320 are electrically connected to each other through first contact point 312 and second contact point 322.

In the present exemplary embodiment, the feeding point (not shown) may be positioned at tip 313 of first contact point 312 and connected to first contact point 312. In this case, an antenna pattern may be formed in a dipole form. Thus, the antenna pattern has a shape laterally extending from the feeding point.

In another exemplary embodiment, the feeding point may be positioned at tip 314 of first antenna pattern 310 opposite to tip 313 at which first contact point 312 of first antenna pattern 310 may be positioned and electrically connected to first antenna pattern 310. In this case, the antenna pattern may be formed in a monopole form. Thus, the antenna pattern has a shape extending in one direction from the feeding point.

Numerical values of sensitivity of a radiation plate according to a provided position of the antenna pattern and a position of the feeding point are shown in Table 1.

TABLE 1

| | Measured Position | | |
|---|---|---|---|
| Provided Position | In front of mobile terminal | To left of mobile terminal | To right of mobile terminal |
| Formed only in carrier | −50 dBm | −44 dBm | −40.5 dBm |
| Formed only in case | −51.5 dBm | −46 dBm | −40 dBm |
| Formed in both carrier and case (monopole type) | −54 dBm | −48.5 dBm | −43.5 dBm |
| Formed in both carrier and case (dipole type) | −54 dBm | −48 dBm | −43.5 dBm |

Table 1 shows a measured result of sensitivity of a radiation plate using a Digital Multimedia Broadcasting (DMB) tester.

As shown in Table 1, an antenna device electrically connected by forming an antenna pattern in the carrier and the case according to the present invention has improved sensitivity of about 4 dBm in each direction compared to an antenna device electrically connected by forming an antenna pattern in only a carrier or a case. A monopole type and a dipole type provide a minimal effect to the sensitivity of the antenna.

In another experiment, coverage was measured for a weak electric field test. The coverage measures how often a screen image of a final terminal (output terminal) may be interrupted and may be represented by a ratio of a screen output time to a measurement time. As a measured result, in a case where the antenna pattern is formed only in the carrier, coverage is 71%, but in a case of the dipole type, coverage is 86%.

Figure 2:
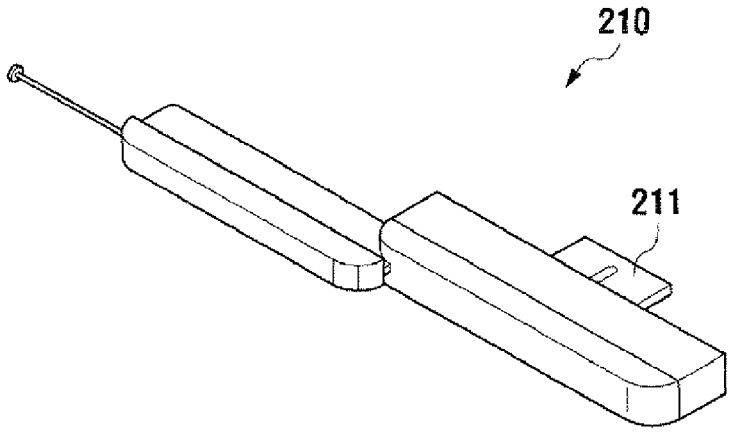
FIG. 2 ( PRIOR ART )
FIG. 2 is a perspective view illustrating a conventional external antenna device for digital broadcasting of a mobile terminal.

In another exemplary embodiment of the present invention, an antenna device of a mobile terminal may further include an insertion hole for inserting an external antenna device. The insertion hole may be connected to a feeding point. When the external antenna device is inserted into the insertion hole, the external antenna device may be connected to the feeding point. Because the mobile terminal may be used while moving, the mobile terminal may be used in a weak electric field region in a very weak electric wave receiving state, for example a shaded region. In this case, by inserting the external antenna device shown in FIG. 2 into the insertion hole of the mobile terminal, the external antenna device may be used as an antenna device of the mobile terminal.

An antenna device of a mobile terminal according to an exemplary embodiment of the present invention may be used for a signal requiring a low frequency band antenna, such as a terrestrial digital broadcasting antenna.

A mobile terminal according to an exemplary embodiment of the present invention may be a mobile electronic device such as a mobile phone, Personal Digital Assistant (PDA), Portable Multimedia Player (PMP), navigation, and digital broadcasting receiver.

As described above, according to the present invention, by forming a second antenna pattern in a case of a mobile terminal and contacting the second antenna pattern with a first antenna pattern formed in a carrier, an antenna device may be used in a low frequency band without using a separate external antenna device or protruding the antenna outside of the mobile terminal. Thus, the antenna device of the mobile terminal according to the present invention may be used as an antenna device for terrestrial digital broadcasting with only an antenna device without requiring a separate external antenna device or protruding the antenna outside of the mobile terminal.

Further, a decrease in size and decrease in thickness of a mobile terminal can be achieved by providing an antenna pattern in an empty space in a case.

Although exemplary embodiments of the present invention have been shown and described in detail hereinabove, it should be clearly understood that many variations and/or modifications of the basic inventive concepts taught herein, which may appear to those skilled in the present art, will still fall within the scope and spirit of the present invention. Thus, it is intended that the present invention cover the modifications and variations of this invention provided they come within the scope of the appended claims and their equivalents.

What is claimed is:

1. An antenna device of a mobile terminal having a case comprising a carrier, the antenna device comprising:

a first antenna pattern provided within the case; and a second antenna pattern provided within the case, wherein the second antenna pattern contacts the first antenna pattern, wherein the carrier comprises an upper surface, a lower surface, and a side surface for connecting the upper surface and the lower surface, the first antenna pattern being formed on the side surface of the carrier, and wherein the first antenna pattern comprises a first contact point at one end of the first antenna pattern and the second antenna pattern comprises a second contact point at one end of the second antenna pattern, wherein the first contact point and the second contact point contact each other.

2. The antenna device of claim 1, wherein the first antenna pattern is formed in the carrier.

3. The antenna device of claim 1, wherein the second antenna pattern is formed on an inner surface of the case.

4. The antenna device of claim 1, further comprising a feeding point connected to the first contact point of the first antenna pattern.

5. The antenna device of claim 1, further comprising a feeding point connected to an end of the first antenna pattern opposite to the end of first antenna pattern having the first contact point.

6. The antenna device of claim 1, wherein the first contact point is formed on the upper surface of the carrier.

7. The antenna device of claim 1, wherein the antenna device is an antenna device for terrestrial digital broadcasting.

8. An antenna device of a mobile terminal having a case, the antenna device comprising:

a first antenna pattern provided within the case; and a second antenna pattern provided within the case, wherein the second antenna pattern contacts the first antenna pattern, wherein the first antenna pattern is formed in a carrier, wherein the carrier is provided within the case, wherein the case comprises an upper case and lower case, wherein the carrier is provided in the upper case, and wherein the second antenna pattern is provided in the lower case.

9. An antenna device of a mobile terminal having a case, the antenna device comprising:

a first antenna pattern provided within the case; and a second antenna pattern provided within the case, wherein the second antenna pattern contacts the first antenna pattern, wherein an insertion hole to insert an external antenna device is formed in the case, and wherein the antenna device further comprises a feeding point connected to the external antenna device when the external antenna device is inserted into the insertion hole.

* * * * *